US005551908A

United States Patent [19]

Harada

[11] Patent Number: 5,551,908

[45] Date of Patent: Sep. 3, 1996

[54] CENTERLESS GRINDER AND WHEEL TRUING DEVICE THEREFOR

[75] Inventor: Katsuhiko Harada, Fujisawa, Japan

[73] Assignee: Fuji Oozx, Inc.

[21] Appl. No.: 489,004

[22] Filed: Jun. 8, 1995

Related U.S. Application Data

[63] Continuation of Ser. No. 165,946, Dec. 10, 1993, abandoned.

[30] Foreign Application Priority Data

Apr. 26, 1993 [JP] Japan ..... 5-099101
May 14, 1993 [JP] Japan ..... 5-112615

[51] Int. Cl.[6] ..... B24B 7/00
[52] U.S. Cl. ..... 451/72; 451/49
[58] Field of Search ..... 451/72, 49, 194, 451/5, 8, 9, 11, 178, 246, 252, 56, 57, 58, 190, 195

[56] References Cited

U.S. PATENT DOCUMENTS 1,865,067 12/1928 Warsow ..... 451/194
1,938,764 4/1931 Haas et al. .
4,055,027 10/1977 Freddi ..... 451/49
4,178,719 12/1979 Jessup ..... 451/49
4,497,138 2/1985 Schreiber ..... 451/51
4,551,950 11/1985 Unno et al. ..... 451/21

FOREIGN PATENT DOCUMENTS 2546435 5/1984 France .
315406 7/1929 United Kingdom .
582937 1/1981 United Kingdom .

*Primary Examiner*—D. S. Meislin
*Assistant Examiner*—Derris Banks
*Attorney, Agent, or Firm*—Graham & James LLP

[57] ABSTRACT

A stem and a valve face of an engine valve are ground by first and second grinding wheels respectively. A motor for driving the second grinding wheel is mounted on a first plate movable by a servomotor in a direction perpendicular to the axis of the wheel, and under the first plate, a second plate is disposed to be movable in a direction parallel with the axis of the wheel. The valve face is ground obliquely by the second grinding wheel by moving the two plates. The first grinding wheel is trued by a first dresser movable in directions parallel with and perpendicular to the axis of the first grinding wheel. The second grinding wheel is trued by a second dresser provided at the end of a support strut.

8 Claims, 4 Drawing Sheets

CENTERLESS GRINDER AND WHEEL TRUING DEVICE THEREFOR

This is a continuation of application Ser. No. 08/165,946 filed on Dec. 10, 1993 now abandoned.

BACKGROUND OF THE INVENTION

The present invention relates to a centerless grinder and a wheel truing device for the centerless grinder, and in particular, to a centerless grinder and a wheel truing device for use in grinding a stem and a head simultaneously of a workpiece such as an engine valve.

Engine valves are finished by separate mechanical processes in which a stem is processed with a centerless grinder and a valve face of a head is ground with a grinder that uses a chuck. However, when the stem and the valve face are ground by different grinders respectively, process productivity is poor and the number of machines required is increased. Furthermore, errors are likely to be caused in the concentricity and size accuracy between the stem and the valve face.

To overcome these disadvantages, it is suggested that the stem and the valve face are ground simultaneously using a centerless grinder as shown in FIG. 6.

To a rotary shaft 102 of a motor 101, a first grinding wheel 104 for grinding a stem 103*a* of an engine valve 103 and a second grinding wheel 105 for grinding a valve face 103*c* of a head 103*b* are mounted. Between the first grinding wheel 104 and an adjusting wheel 107 rotated at lower speed by a motor 106, the stem 103*a* of the engine valve 103 is held, and the stem 103*a* and the valve face 103*c* are simultaneously ground by the first and second grinding wheels 104 and 105 respectively by rotating the motors 101 an 106 in the same direction.

However, in the centerless grinder in which the two grinding wheels 104 and 105 are mounted to a single shaft, the rotation speeds of the grinding wheels 104 and 105 are the same, so that the stem 103*a* and the valve face 103*c* are ground at different processing speeds owing to the difference in circumferential speed which depends on the difference in outer diameters of the wheels. That is to say, if the circumferential speed of the first grinding wheel 104 for grinding the stem 103*a* is set to the most suitable grinding condition, the circumferential speed of the second grinding wheel 105 for grinding the valve face 103*c* becomes too slow, thereby increasing the surface roughness of the valve face 103*c*, which requires a good surface finish, so that further finish polishing is required. Conversely, if the circumferential speed of the second grinding wheel 105 is set to the most suitable grinding condition, then the circumferential speed of the first grinding wheel 104 is too fast, thereby causing burning of the stem 103 and rapid wearing of the first grinding wheel 104.

The first and second grinding wheels 104 and 105 are mounted on the same shaft in the conventional grinder above, and as their respective removal amounts are not separately controlled, the grinding wheels 104 and 105 must be trued depending on the extent of wear. Also, when the size of the workpiece and the inclined angle of the valve face are varied, then, the second grinding wheel 105 must be replaced with one of suitable dimensions, thereby requiring complicated setting-up and preparation with a resultant decrease in productivity.

To true the first and second grinding wheels, if they are to be trued by a single dresser, will take a lot of time, thereby further decreasing efficiency and productivity. If the two wheels have different circumferential surfaces (grinding surfaces) and are trued using one dresser, the truing surface of the dresser itself does not wear uniformly, requiring its early replacement. Further, even if the grinding wheels contain different grinding particles (are of different hardness) and have a different speed of wear, they are simultaneously trued at fixed intervals depending on the number of workpieces ground. Therefore, if the time for truing one grinding wheel is set to the most suitable condition, the other wheel will be either excessively or insufficiently trued.

An object of the present invention is to provide a centerless grinder in which the most suitable grinding conditions are available depending on the dimensions or grinding portion sizes of a workpiece to decrease the number of times replacement of a grinding wheel and to facilitate operation of the grinder.

Another object of the present invention is to provide a wheel truing device for a centerless grinder in which grinding wheels are rapidly trued to the most suitable grinding conditions even if the grinding wheels are of different types and have different wear speeds.

SUMMARY OF THE INVENTION

According to one aspect to the present invention, there is provided a centerless grinder for grinding a workpiece which comprises a head and a stem, the grinder comprising: a first grinding wheel which rotates at high speed; an adjusting wheel which is movable with respect to the first grinding wheel and rotates at speed lower than the first grinding wheel, the stem of the workpiece being held between the first grinding wheel and the adjusting wheel so that the stem may be ground; a second grinding wheel for grinding the head of the workpiece, the second grinding wheel rotating on an axis in parallel with an axis of the first grinding wheel; drive means for rotating the second grinding wheel; and means for moving the drive means in directions parallel with and perpendicular to an axis of the workpiece so that the head may be ground by the second grinding wheel in directions parallel with, perpendicular to and oblique to the axis of the workpiece.

The stem and head of the workpiece are ground by the two wheels respectively connected to separate drive means, so that the most suitable processing conditions are available depending on the size of the workpiece, thereby increasing overall grinding accuracy. The second grinding wheel can be reciprocated in the directions parallel with, perpendicular to, and oblique to the axis of the workpiece, so that no replacement of the second grinding wheel is required even when the head of the workpiece has a different diameter, thereby reducing the number of times required for replacement and preparation and increasing productivity.

According to another aspect of the present invention, there is provided a wheel truing device for a centerless grinder which comprises a first grinding wheel for grinding a stem of a workpiece and a second grinding wheel for grinding a head of the workpiece, respectively, the device comprising: a first dresser for truing the first grinding wheel; moving means for reciprocating the first dresser in a direction parallel with an axis of the first grinding wheel; first positioning means for extending or retracting the first dresser in a direction perpendicular to the axis of the first grinding wheel so that a truing surface of the first dresser contacts an outer circumferential surface of the first grinding wheel; a second dresser movable in a direction perpendicular to an axis of the second grinding wheel so as to true the second grinding wheel; and second positioning means for extending or retracting the second dresser in a direction perpendicular to the axis of the second grinding wheel so that a truing surface of the second dresser may contact with an outer circumferential surface of the second grinding wheel.

The outer circumferential surface of the first rotating grinding wheel is contacted by the truing surface of the first dresser by operating the first positioning means and then, the moving means is operated to reciprocate the first dresser in the direction parallel with the axis of the first grinding wheel, so that the first grinding wheel is suitably trued. When the second dresser is moved in a direction perpendicular to the axis of the second grinding wheel by the first positioning means, the outer circumferential surface of the second rotating grinding wheel is trued by the truing surface of the second dresser. The position of the second dresser is simultaneously moved with respect to the moving means, enabling tapered surface of the second grinding wheel to be suitably trued.

The advantages achieved by the wheel truing device of the invention are as follows:

(a) The first and second grinding wheels are trued by the first and second dressers respectively, thereby decreasing truing time and increasing productivity.

(b) The truing time of the first and second grinding wheels is varied depending on the type of grinding particles and the rate of wear, whereby the grinding wheels are trued to be in the most suitable condition for increasing the working accuracy and lives of the wheels.

(c) Suitable materials can be selected as the rigid particles for the truing surfaces of the first and second dressers, depending on the types of grinding particles used for the first and second grinding wheels.

BRIEF DESCRIPTION OF THE DRAWINGS

The above and other features and advantages of the present invention will be apparent from the following description of the accompanying drawings, wherein.

DESCRIPTION OF PREFERRED EMBODIMENTS

Figure 1:
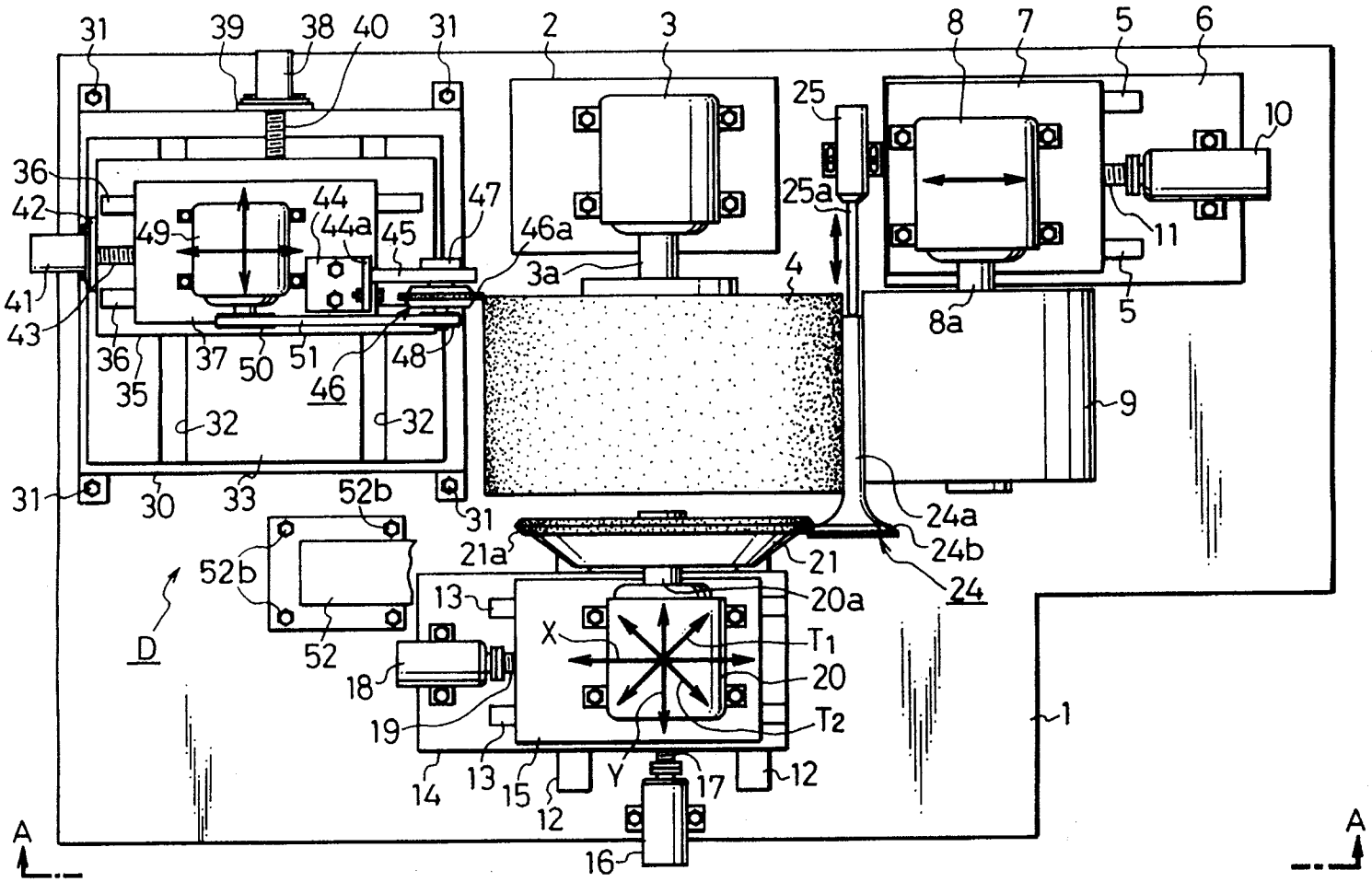
FIG. 1 is a top plan view which illustrates one embodiment of the present invention.
Figure 2:
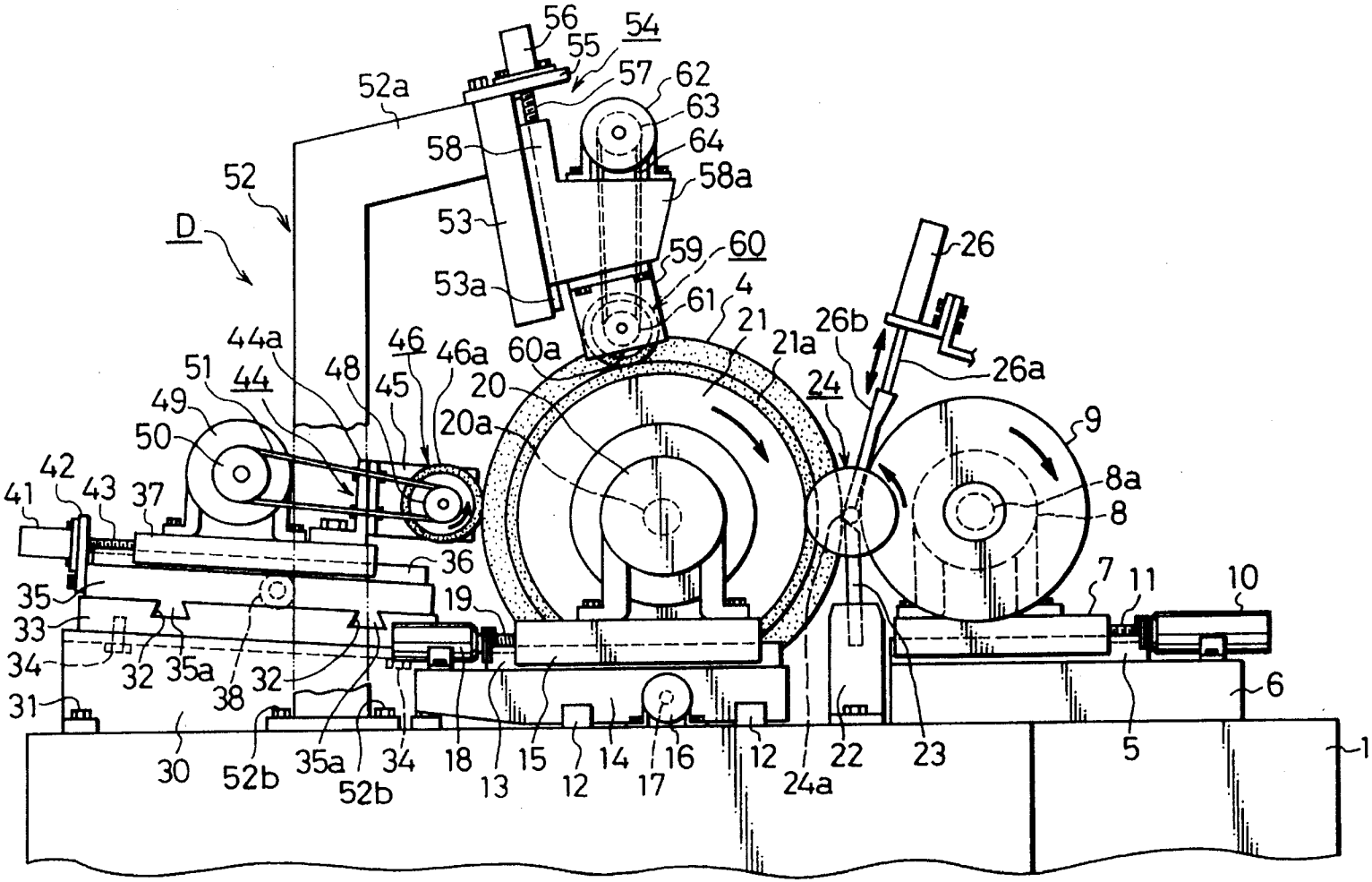
FIG. 2 is a view seen from the arrow A—A in FIG. 1.

FIGS. 1 and 2 show a centerless grinder according to the present invention, and at a front portion (upper portion of FIG. 1) of a base 1 which is placed on a floor, a rectangular plate 2 is fixed. On the plate 2, a first spindle type motor 2 is placed. To a rotary shaft 3*a* of the first motor 2, a first wider area grinding wheel 4 for grinding a stem 24*a* of a workpiece such as an engine valve 24 (to be described below) is mounted to rotate in a clockwise direction, as seen from its rear.

A plate 6 which has a pair of guide rails 5 and 5 is fixed on the base 1 to the right side of the plate 2. On the guide rails 5 and 5, a moving plate 7 is engaged by sliding. A second spindle type motor 8 is mounted on the movable plate 7, and to a rotary shaft 8*a* of the motor 8, an adjusting wheel 9 adjacent to the first grinding wheel 4 and nearly equal to the width of the grinding wheel 4 is mounted to rotate in the same direction. The axis of the adjusting wheel 9 is inclined such that the front end of the axis is lower than the axis of the first grinding wheel 4, thereby enabling a forward thrusting force to the engine valve 24 during grinding. A stepping- or servomotor 10 is fixed on the plate 6 on the right side of the moving plate 7, and by rotation of a threaded rod 11, connected to a rotary shaft of the motor 10, and into the plate 7, the second motor 8 and the adjusting wheel 9 are moved with respect to the first grinding wheel 4.

Behind the first grinding wheel 4, a pair of guide rails 12 and 12 is fixed onto the base 1, and is engaged by sliding with the lower surface of a rectangular moving plate 14 which has a pair of guide rails 13 on the upper surface. A rectangular moving plate 15 is engaged by sliding with the guide rails 13 on the moving plate 14. A stepping- or servomotor 16 is fixed onto the rear portion of the base 1 between the guide rails 12 aligned to the axis of the first grinding wheel 4, and a threaded rod 17 connected with the rotary shaft of the motor 16 is engaged with the moving plate 14. A stepping- or servomotor 18 is fixed on the moving plate 14 between the guide rails 13, and a threaded rod 19 connected to the rotary shaft of the motor 18 is engaged with the moving plate 15.

A third spindle type motor 20 is mounted on the moving plate 15 at the same height as and in parallel with the first motor 3. A relatively thin second grinding wheel 21 for grinding a valve face 24*b* of an engine valve 24 is mounted to a rotary shaft 20*a* of the third motor 20. The servomotors 16 and 18 move the moving plates 14 and 15 respectively by rotary screw action, whereby the second grinding wheel 21 moves in a right-left direction as shown by an arrow "X", in a front-rear direction as shown by an arrow "Y" and in oblique directions as shown by arrows "$T_1$" and "$T_2$". On a support plate 22 bolted on the base 1 between the first grinding wheel 4 and the adjusting wheel 9, a removable thin blade 23 (see FIG. 2) with a front-to-rear length that is a little smaller than the thickness of the first grinding wheel 4 is attached.

The engine valve 24 which is supplied between the first grinding wheel 4 and the adjusting wheel 9 by workpiece supply mechanism (not shown) has a stem 24*a* which is supported by the blade 23 at equal height to, and in parallel with the axis of the first grinding wheel 4.

The numeral 25 denotes an air-cylinder type workpiece holder positioning device (see FIG. 1) which is disposed on the front portion of the base 1 between the first grinding wheel 4 and the adjusting wheel 9, and a rod 25*a* acts not only as stopper for preventing forward movement of the engine valve 24, but also as ejector for discharging treated engine valve 24 rearwards. The numeral 26 denotes an inclined air-cylinder type workpiece holding device (see FIG. 2) supported by a suitable fixed bracket (not shown), which prevents the engine valve 24 from jumping up by bringing the lower end 26*b* fixed to the rod 26*a*, close to the upper side of the stem 24*a* or into sliding contact between the former and the latter. Thus, when the stem 24*a* and a valve face 24*b* of the engine valve 24 are ground, the relative distances between the first grinding wheel 4 and the adjusting wheel 9, the front-to-rear and right-to-left positions of the second grinding wheel 21 and the front-to-rear position of the workpiece holder device 25 are adjusted depending on the dimensions of the engine valve 24. Then, the engine valve 24, with a rearward-directed valve face **24*b* held by the workpiece supply device, is supported between the first grinding wheel 4 and the adjusting wheel 9, the lower end of the stem 24*a* is supported by a blade 23, and the axial end is contacted by the end of the rod 25*a***.

Then, after the workpiece holder device 25 is operated to prevent the stem **24*a* from jumping up, the first and second grinding wheels 4 and 21 are rotated at high speeds in a direction shown by an arrow, and the adjusting wheel 9 at a lower speed in the same direction of rotation, thereby simultaneously grinding the stem 24*a* by the first grinding wheel 4 and the valve face 24*b* by a tapered grinding surface 21*a***.

Figure 3:
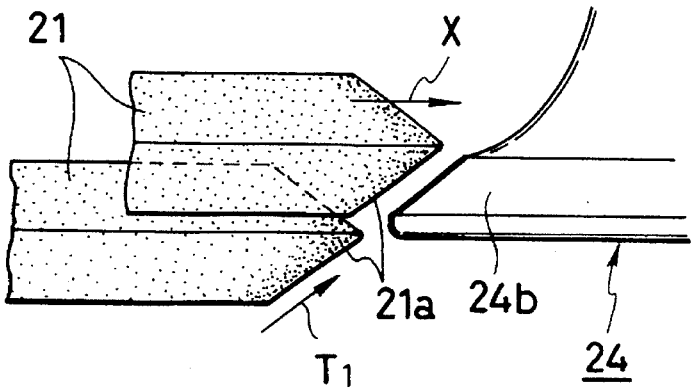
FIG. 3 is a view illustrating the grinding of a valve face of a valve by second grinding wheel.

As shown in FIG. 3, to grind the valve face **24*b*, the second grinding wheel 21 may be moved in the direction of the arrow "X" by controlling only the motor 18 or in the direction of the arrow "$T_1$" by controlling both the motors 16 and 18**.

As described above, in the centerless grinder in the foregoing embodiment, the first grinding wheel 4 for grinding the stem **24*a* and the second grinding wheel 21 for grinding the valve face 24*b* are driven by the first and third motors 3 and 20 respectively, thereby controlling the circumferential speeds of the grinding wheels 4 and 21 and achieving the most suitable processing condition depending on the size of the engine valve 24. For example, the higher circumferential speed of the second grinding wheel 21 greatly improves the surface finish of the valve face 24*b***, which is difficult to achieve using the prior art.

The second grinding wheel 21 can be moved in the directions of the arrows "X", "Y", "$T_1$" and "$T_2$" respectively, thereby avoiding the necessity to replace of the second grinding wheel 21 with another size of wheel, even if the outer diameter and angle of inclination of the valve face **24*b* are varied, and the amount of material removed can be controlled regardless of the wear rate of the first grinding wheel 4. Particularly, by selecting the form of the grinding surface 21*a* of the second grinding wheel 21 and providing feed in the direction of the arrow "$T_1$", several kinds of valve faces with different angles of inclination could be processed. It is advantageous to reduce the wheel width when feed is provided in an oblique direction. When the stem 24*a* and the valve face 24*b* of the engine valve 24 are simultaneously ground using the centerless grinder having the two grinding wheels 4 and 21, the resultant concentricity is very good, such as run-out values of 10 μm for the valve face 24*b* with respect to the stem 24*a*. If the concentricity is good, this is advantageous for keeping within allowable limitations for the bending of the stem when the stem 24*a*** is subjected to "tuft ride" treatment.

In the foregoing embodiment, the second grinding wheel 21 and the moving plate 14 on which the wheel 21 is mounted are placed on the base 1 behind the first grinding wheel 4, but may also be placed on the base beside the adjusting wheel 9. The subject to be processed by the centerless grinder according to the present invention, the workpiece, is not limited to the engine valve 24.

A wheel truing device "D" for the first and second grinding wheels 4 and 21 will be described below. A square plate 30 having an inverted U-shape cross-section with an inclined upper surface is fixed onto the base 1 by four bolts 31 on the left side of the first grinding wheel 4, and on the upper surface of the base plate 30, a fixed square plate 33 with a pair of guide grooves 32 is fixed by a plurality of bolts 34 which are inserted through the base plate 30. On the fixed plate 33, a moving rectangular plate 35 is provided to be movable in a front-rear direction by the sliding engagement of a pair of projections **35*a* into the guide grooves 32. A rectangular moving plate 37 is engaged by sliding onto a plurality of guide rails 36 on the moving plate 35**.

A stepping- or servomotor 38 is fixed by a bracket 39 to the upper portion of the front surface of the plate 30, and a threaded rod 40 which is connected to the rotary shaft of the motor is engaged into the moving plate 35. The moving plate 35, the servomotor 38, the threaded rod 40 and other members constitute a moving device for moving a first dresser 46 (to be described below) in parallel with the axis of the first grinding wheel. In the middle of the left-side end face, a stepping- or servomotor 41 is fixed by a bracket 42 to the moving plate 35, and a threaded rod 43 connected to the rotary shaft of the motor 41 is engaged with the moving plate 37. The moving plate 37, the servomotor 41, the threaded rod 43 and other members constitute a positioning device for extending or retracting the first dresser 46 in a direction perpendicular to the axis of the first grinding wheel 4.

The numeral 44 denotes an inverted L-shaped bracket bolted on the right rear portion of the moving plate 37, and a support plate 45 is bolted to the right side **44*a* of the bracket 44. The first rotary type dresser 46 for truing the first grinding wheel 4 rotates in a bearing 47 on the rear surface of the support plate 45. Rigid particles such as natural or artificial diamonds and CBN are embedded in the outer circumferential surface or truing surface of a rotary wheel 46*a* of the first dresser 46**.

An endless belt 51 is fitted as driving means between a pulley 48 fixed to the rotary shaft of the first dresser 46 and a pulley 50 fixed to the rotary shaft of a fourth motor 49 mounted on the moving plate 37, and the first dresser 46 is rotated at high speed by the fourth motor 49 in an anticlockwise direction to rotate with respect to the first grinding wheel 4. To the left of the moving plate 14 and behind the base plate 30 on the base 1, an inverted L-shaped strut 52 is fixed by bolts **52*b*. A guide block 53 fixed to the end of support portion 52*a* of the strut 52 has a positioning device 54 which moves in a direction oblique and perpendicular to the axis of the second grinding wheel 21. The positioning device 54 comprises a stepping- or servomotor 56 fixed to a bracket 55 on the upper surface of the guide block 53, a threaded rod 57 connected to the rotary shaft of the motor 56; and a moving head 58 which is engaged by sliding with a guide rail 53*a* formed in a right side of the guide block 53, the threaded rod 57 being a threaded fit in the head 58. In FIG. 1, the positioning device 54, a second dresser 60 and associated parts are omitted to avoid obscuring the structure around the second grinding wheel 21**.

On the front surface of the support plate 59 bolted at the lower end of the positioning head 58, the second dresser 60 for truing the second grinding wheel 21 is rotated in a bearing (not shown) above and in parallel with the axis of the second grinding wheel 21. In the outer circumferential surface of the rotary wheel **60*a* of the second dresser 60, rigid particles such as natural or artificial diamonds and CBN are embedded in the same way as for the first dresser 46. The second dresser 60 is rotated at high speed in an anticlockwise direction, seen from a rear direction, by an endless belt 64 which is fitted between a pulley 61 fixed to the rotary shaft of the second dresser 60 and a pulley 63 on the rotary shaft of a fifth motor 62 being the drive means mounted on a horizontal support 58***a* of the positioning head 58.

Figure 4:
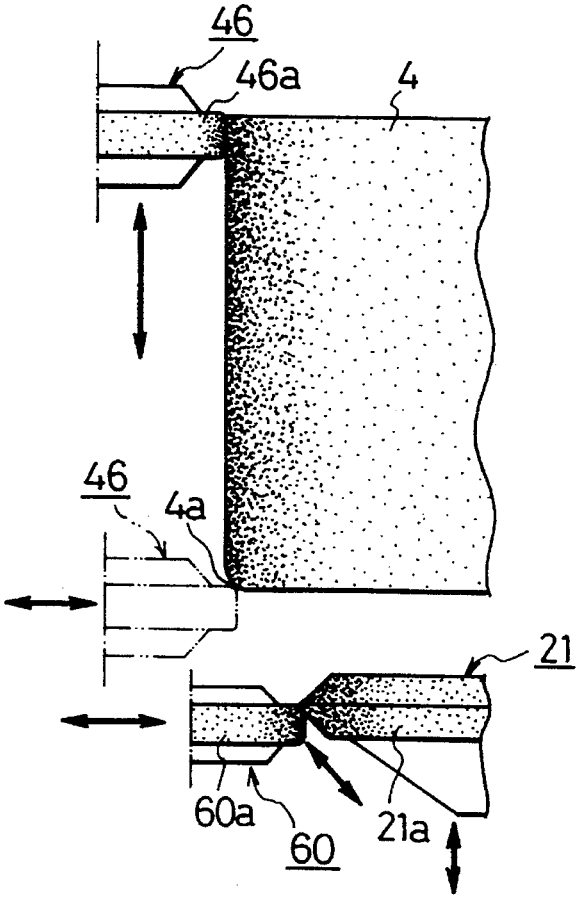
FIG. 4 is a view illustrating the truing of the first and second grinding wheels.

A method of truing the first and second grinding wheels 4 and 21 by the wheel truing devices in the foregoing embodiment will be described. In order to true the first grinding wheel 4, the motors 38 and 41 are first operated to move the moving plate 37 in front-rear and right-left directions, thereby determining an initial position in which the outer circumferential surface of the rotary wheel 46*a* of the first dresser 46 mounted on the moving plate 37 contacts with either the front end or rear end of the outer circumferential surface of the first grinding wheel 4 as shown in FIG. 4. In this situation, the first and fourth motors 3 and 49 are operated, so that the first grinding wheel 4 and the first dresser 46 rotate at high speeds in directions shown by the arrows in FIG. 2, and simultaneously, the servomotor 38 is operated in a forward or reverse direction, so that the first dresser 46 on the moving plate 37 is reciprocated along the full thickness of the first grinding wheel 4. In this case, an arced portion 4*a* that has been formed in the circumferential rear edge of the first grinding wheel 4 is trued by controlling the servomotor 41 in a forward or reverse rotation and moving the first dresser 46 in a right-left direction. Thus, all the outer circumferential surface of the first grinding wheel 4 can be trued to a desired form.

To true the second grinding wheel 21, the servomotor 56 is first operated to lower the positioning head 58, and simultaneously, the servomotors 16 and 18 are operated to move the second grinding wheel 21 in the directions of the arrows "X" and "Y", thereby determining an initial position such that the front corner of the outer circumferential surface of the rotary wheel 60*a* of the second dresser 60 mounted to the lower end of the retractable head 58 contacts with either the front end or the rear end of the tapered grinding surface 21*a* of the second grinding wheel 21. In this situation, the third and fifth motors 20 and 62 are operated to rotate the second grinding wheel 21 and the second dresser 60 simultaneously, and by controlling the forward and reverse directions of the servomotors 16 and 56, the second grinding wheel 21 and the second dresser 60 are simultaneously moved in directions parallel with and perpendicular to the axis of the second grinding wheel 21 respectively, so that the second dresser 60 is reciprocated in an oblique direction (shown by an arrow in FIG. 4) along the inclined grinding surface 21*a* of the second grinding wheel 21. Thus, the grinding surface 21*a* of the second grinding wheel 21 is trued to a desired form.

As described above, in the truing device of the above embodiment, the first and second grinding wheels 4 and 21 are trued by the first and second dressers 46 and 60 respectively, so that truing is completed in a short time. Since truing intervals can be selected depending on the degree of wear of the grinding wheels 4 and 21, the grinding wheels 4 and 21 are always trued to give the most suitable grinding conditions, to stabilize the processing accuracy and to increase the operating lives of the grinding wheels 4 and 21, thereby reducing the number of times they need to be replaced.

Depending on the size, material and processing requirements of the engine valve 24, when grinding particles of different hardness of the grinding surface are used for the grinding surfaces of the first and second grinding wheels 4 and 21, suitable and cheaper materials may be selected for the rigid particles of the truing surfaces of the first and second dressers 46 and 60, which is more economical.

Figure 5:
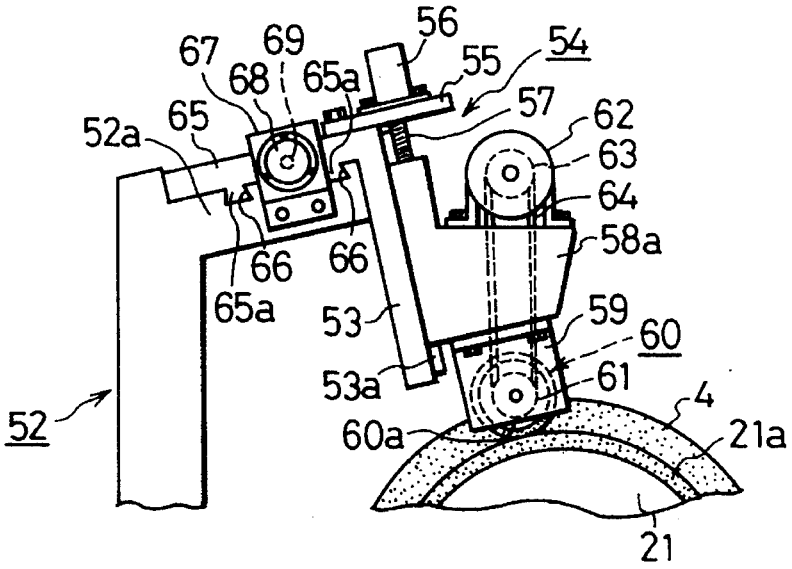
FIG. 5 is a rear elevational view of the main portion of another embodiment of a moving device of a second dresser.
Figure 6:
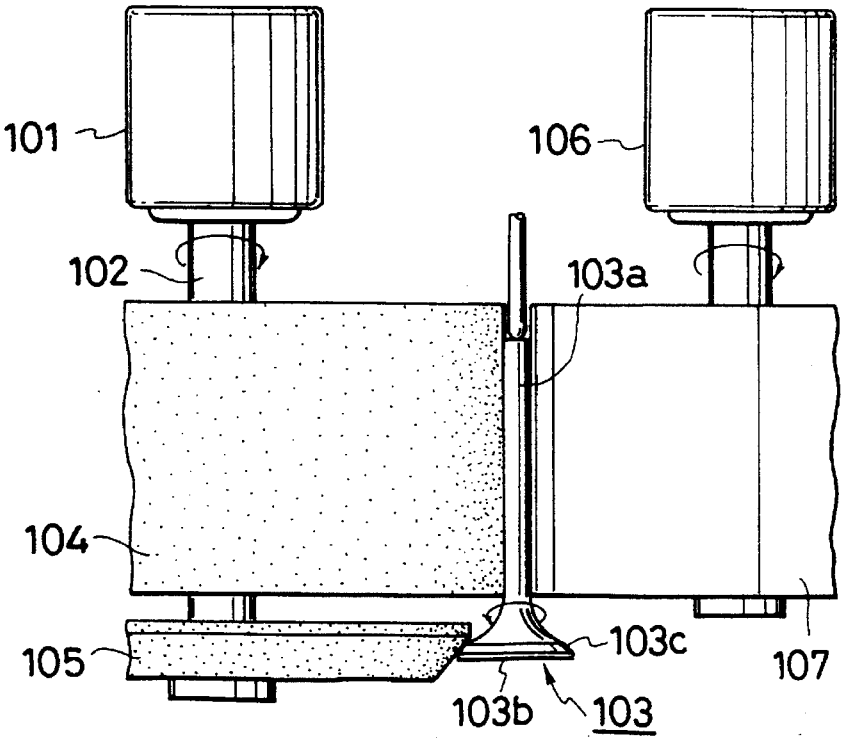
FIG.6 PRIOR ART
FIG. 6 is a top plan view of a conventional centerless grinder.

FIG. 5 illustrates another embodiment of the second dresser 60 which has a device for moving the second dresser 60 in a direction parallel with the rotation axis of the second grinding wheel 21. At the upper end of the guide block 53, a slightly inclined moving plate 65 is mounted. A pair of projections 65*a* is formed on the lower surface of the moving plate 65 and extends in the front-rear direction, fitting into a pair of guide grooves 66 on the upper surface of a support portion 52*a*, so that this positioning device "D" moves a fifth motor 62 and a second dresser 60 mounted onto this device in the front-rear direction. On a bracket 67 bolted in the middle of the rear end face of the support portion 52*a*, a stepping- or servomotor 68 is mounted as means of driving, and a threaded rod 69 connected to the rotary shaft of the motor 68 is engaged with the moving plate 65. Thus, by operating the servomotors 56 and 68, the second dresser 60 moves in directions parallel with and perpendicular to the axis of the second grinding wheel 21. In this embodiment, the second grinding wheel 21 is not moved. Only the second dresser 60 is moved, thereby truing the tapered grinding surface 21*a* of the second grinding wheel 21.

If the second dresser 60 and its support structure are mounted in a position such that the truing surface of the second dresser 60 traverses the grinding surface of the second grinding wheel 21 (such as a position adjacent to the first dresser) by moving the second grinding wheel 21 in the right-left direction, truing will be possible by moving only the second grinding wheel 21 in the directions of the the arrows of "X", "Y", "$T_1$" and "$T_2$" without any positioning means being required for the second dresser 60.

In the case that the grinding surface 21*a* of the second grinding wheel 21 is not required to be tapered when the end of a workpiece other than on engine valve is ground, only the positioning device 54 for moving the second dresser 60 in a direction perpendicular to the axis of the second grinding wheel 21 may be required.

The foregoing merely relates to embodiments of the present invention. Various modifications and changes may be carried out by person skilled in the art without departing from the scope of claims as below.

What is claimed is:

1. A centerless grinder for grinding a workpiece which comprises a head and a stem, the grinder comprising:

a first grinding wheel which rotates at high speed;

first drive means for driving the first grinding wheel;

an adjusting wheel which is movable with respect to the first grinding wheel and rotates at speed lower than the first grinding wheel, the stem of the workpiece being held between the first grinding wheel and the adjusting wheel so that the stem may be ground;

a second grinding wheel for grinding the head of the workpiece, the second grinding wheel rotating on an axis in parallel with an axis of the first grinding wheel;

second drive means capable of rotating the second grinding wheel while the first grinding wheel is driven; and means for moving the second drive means in directions parallel with and perpendicular to an axis of the workpiece so that the head may be ground by the second grinding wheel in directions parallel with, perpendicular to, and oblique to the axis of the workpiece.

2. A centerless grinder as defined in claim 1 wherein the means for moving the second drive means comprises a first moving plate on which the second drive means is disposed, and a second moving plate along which the first moving plate slides in the direction perpendicular to the axis of the workpiece, the second moving plate being slidable in the direction parallel with the axis of the workpiece.

3. A centerless grinder as defined in claim 2 wherein the first moving plate is connected to a servomotor via a threaded rod and slides on a rail of the second plate which is connected to a servomotor via a threaded rod, the second moving plate sliding on a guide rail.

4. A centerless grinder as defined in claim 1 wherein the first and second drive means comprise motors.

5. A centerless grinder as defined in claim 1 wherein the workpiece comprises an engine valve which has on the head a valve face to be ground by the second grinding wheel.

6. A wheel truing device for a centerless grinder for grinding a workpiece which comprises a head and a stem, the grinder comprising a first grinding wheel which rotates at high speed; first drive means for driving the first grinding wheel; an adjusting wheel which is movable with respect to the first grinding wheel and rotates at speed lower than the first grinding wheel, the stem of the workpiece being held between the first grinding wheel and the adjusting wheel so that the stem may be ground; a second grinding wheel for grinding the head of the workpiece, the second grinding wheel rotating on an axis in parallel with an axis of the first grinding wheel; second drive means for rotating the second grinding wheel; and means for moving the second drive means in directions parallel with and perpendicular to an axis of the workpiece so that the head may be ground by the second grinding wheel in directions parallel with, perpendicular to, and oblique to the axis of the workpiece, the wheel truing device comprising:

a first dresser for truing the first grinding wheel;

means for moving the first dresser in a direction parallel with an axis of the first grinding wheel;

first positioning means for extending or retracting the first dresser in a direction perpendicular to the axis of the first grinding wheel so that a truing surface of the first dresser contacts with an outer circumferential surface of the first grinding wheel, the first positioning means comprising a first moving plate and a second moving plate which are connected to a servomotor via a threaded rod, and the second moving plate being mounted on the first moving plate;

a second dresser for truing the second grinding wheel; and second positioning means for moving the second dresser in the direction perpendicular to the axis of the second grinding wheel so that a truing surface of the second dresser may contact with an outer circumferential surface of the second grinding wheel.

7. A wheel truing device for a centerless grinder for grinding a workpiece which comprises a head and a stem, the grinder comprising a first grinding wheel which rotates at high speed; first drive means for driving the first grinding wheel; an adjusting wheel which is movable with respect to the first grinding wheel and rotates at speed lower than the first grinding wheel, the stem of the workpiece being held between the first grinding wheel and the adjusting wheel so that the stem may be ground; a second grinding wheel for grinding the head of the workpiece, the second grinding wheel rotating on an axis in parallel with an axis of the first grinding wheel; second drive means for rotating the second grinding wheel; and means for moving the second drive means in directions parallel with and perpendicular to an axis of the workpiece so that the head may be ground by the second grinding wheel in directions parallel with, perpendicular to, and oblique to the axis of the workpiece, the wheel truing device comprising:

a first dresser for truing the first grinding wheel; means means for moving the first dresser in a direction parallel with an axis of the first grinding wheel;

first positioning means for extending or retracting the first dresser in a direction perpendicular to the axis of the first grinding wheel so that a truing surface of the first dresser contacts with an outer circumferential surface of the first grinding wheel;

a second dresser for truing the second grinding wheel; and second positioning means for moving the second dresser in the direction perpendicular to the axis of the second grinding wheel so that a truing surface of the second dresser may contact with an outer circumferential surface of the second grinding wheel.

8. A wheel truing device for a centerless grinder for grinding a workpiece which comprises a head and a stem, the grinder comprising a first grinding wheel which rotates at high speed; first drive means for driving the first grinding wheel; an adjusting wheel which is movable with respect to the first grinding wheel and rotates at speed lower than the first grinding wheel, the stem of the workpiece being held between the first grinding wheel and the adjusting wheel so that the stem may be ground; a second grinding wheel for grinding the head of the workpiece, the second grinding wheel rotating on an axis in parallel with an axis of the first grinding wheel; second drive means for rotating the second grinding wheel; and means for moving the second drive mans in directions parallel with and perpendicular to an axis of the workpiece so that the head may be ground by the second grinding wheel in directions parallel with, perpendicular to, and oblique to the axis of the workpiece, the wheel truing device comprising:

a first dresser for truing the first grinding wheel;

means for moving the first dresser in a direction parallel with an axis of the first grinding wheel;

first positioning means for extending or retracting the first dresser in a direction perpendicular to the axis of the first grinding wheel so that a truing surface of the first dresser contacts with an outer circumferential surface of the first grinding wheel;

a second dresser for truing the second grinding wheel;

second positioning means for moving the second dresser in the direction perpendicular to the axis of the second grinding wheel so that a truing surface of the second dresser may contact with an outer circumferential surface of the second grinding wheel; and means for moving the second dresser in a direction parallel with the axis of the second grinding wheel, the means for moving the second dresser comprising a moving plate connected to a servometer via a threaded rod, the moving plate being engaged with a support portion of a strut to be slidable on the support portion.

* * * * *